US008766888B2

(12) United States Patent
Lee

(10) Patent No.: US 8,766,888 B2
(45) Date of Patent: Jul. 1, 2014

(54) IN PLANE SWITCHING MODE LIQUID CRYSTAL DISPLAY DEVICE

(75) Inventor: Ju-Young Lee, Gyeongsangbuk-Do (KR)

(73) Assignee: LG Display Co., Ltd., Seoul (KR)

( * ) Notice: Subject to any disclaimer, the term of this patent is extended or adjusted under 35 U.S.C. 154(b) by 1043 days.

(21) Appl. No.: 11/639,329

(22) Filed: Dec. 15, 2006

(65) Prior Publication Data

US 2007/0229419 A1 Oct. 4, 2007

(30) Foreign Application Priority Data

Mar. 31, 2006 (KR) ..... 10-2006-0029928

(51) Int. Cl.
*G09G 3/36* (2006.01)

(52) U.S. Cl.
CPC ..... *G09G 3/3659* (2013.01); *G09G 2300/0895* (2013.01); *G09G 3/3648* (2013.01)
USPC ..... 345/87; 349/141

(58) Field of Classification Search
USPC ..... 349/141; 345/87
See application file for complete search history.

(56) References Cited

U.S. PATENT DOCUMENTS

| | | | | |
|---|---|---|---|---|
| 6,069,600 | A * | 5/2000 | Saishu et al. | 345/87 |
| 7,154,463 | B2 * | 12/2006 | Kwag | 345/94 |
| 7,965,345 | B2 * | 6/2011 | Kim et al. | 349/43 |
| 2006/0290863 | A1 * | 12/2006 | HoeSup | 349/141 |

* cited by examiner

*Primary Examiner* — Amare Mengistu
*Assistant Examiner* — Joseph G Rodriguez
(74) *Attorney, Agent, or Firm* — McKenna Long & Alridge LLP

(57) ABSTRACT

Disclosed is an IPS mode LCD device, which comprises first and second substrates, N gate lines arranged on the first substrate substantially in parallel, M data lines arranged to cross the gate lines so as to define m×n pixel regions, a plurality of first switching devices formed at each crossing of the gate lines and the data lines, first electrodes electrically connected with the first switching devices, second electrodes generating a horizontal electric field along with the first electrodes in the pixel regions, a common voltage supplier generating a common voltage from an n−1th gate line and an nth gate line and supplying the generated common voltage to the second electrodes, and a liquid crystal layer formed between the first and second substrates.

11 Claims, 5 Drawing Sheets

IN PLANE SWITCHING MODE LIQUID CRYSTAL DISPLAY DEVICE

The application claims the benefit of Korean Patent Application No. 10-2006-029928, filed on Mar. 31, 2006, which is incorporated by reference for all purposes as if fully set forth herein.

BACKGROUND OF THE INVENTION

1. Field of the Invention

The present invention relates to a liquid crystal display (LCD) device, and more particularly, to an in plane switching mode LCD device, in which a circuit for a common voltage and additional elements thereof are omitted to reduce a flicker.

2. Discussion of the Related Art

Recently, various display devices serving as interface between a human being and information through various kinds of visual information are used. In particular, LCD devices are widely used as the next generation display devices, replacing conventional cathode ray tubes (CRT) because of the advantages of LCD devices, such as a high picture quality, a low power consumption, a light weight, and the like.

LCD devices use the optical anisotropy of liquid crystals to display an image by controlling the transmittance of light supplied from a light source. The transmittance of the light is controlled by applying an electric field to liquid crystals contained between a thin film transistor array substrate and a color filter substrate, thereby rearranging the liquid crystals.

The LCD device is divided into a twisted nematic (TN) mode LCD device and an in plane switching (IPS) mode LCD device depending on a driving mode of liquid crystal molecules.

The TN mode LCD device includes a thin film transistor array substrate including a pixel electrode, a color filter array substrate including a common electrode, and a liquid crystal layer disposed between the two substrates. The liquid crystal layer is arranged depending on a vertical electric field generated between the common electrode and the pixel electrode. The pixel electrode is formed per unit pixel, and the common electrode is formed on an entire surface of the color filter substrate.

The TN liquid crystal is rearranged by a vertical electric field of the pixel electrode on the thin film transistor array substrate and the common electrode formed on the color filter substrate. Accordingly, the light transmittance of the TN liquid crystal changes in accordance with the viewing angle in all directions, which limits the fabrication of large area LCD devices. That is, in the TN mode LCD device of which liquid crystal is rearranged by the vertical electric field, the light transmittance is symmetrically distributed according to a viewing angle in right and left directions but is asymmetrically distributed according to a viewing angle in up and down directions. For this reason, image inversion is generated in up and down directions, thereby narrowing the viewing angle.

In order to solve the above problem, an in-plane switching (IPS) mode LCD device of which liquid crystal is driven by a horizontal electric field has been proposed.

The IPS mode LCD device includes a thin film transistor array substrate including common and pixel electrodes, a color filter substrate including common electrodes, and a liquid crystal layer formed between the two substrates, wherein the liquid crystal layer is rearranged by the horizontal electric field between the common electrode and the pixel electrode. The common and pixel electrodes are alternately formed at constant intervals for unit pixel.

The IPS mode LCD device enhances viewing angle characteristics such as contrast ratio, gray inversion, and color shift, as compared to an LCD device where the liquid crystal is driven using a vertical electric field. Therefore, since the IPS mode LCD device obtains a wider viewing angle, it is widely used for the fabrication of LCD devices with a large display area.

Hereinafter, the IPS mode LCD device constructed as above will be described with reference to FIG. 1 and FIG. 2.

FIG. 1 is a plan view illustrating a thin film transistor array substrate in a general IPS mode LCD device, and FIG. 2 is a circuit diagram illustrating an equivalent circuit of FIG. 1.

As shown in FIG. 1 and FIG. 2, the IPS mode LCD device includes a plurality of gate lines GL1 to GLn arranged on a thin film transistor array substrate in a horizontal direction, and a plurality of data lines DL1 to DLm arranged on the substrate in a vertical direction to cross the gate lines GL1 to GLn. A plurality of pixels P1 (n×m) are defined at each crossing between the gate lines GL1 to GLn and the data lines DL1 to DLm. Each pixel P1 is provided with a pixel electrode 11 and a switching device T1.

The thin film transistor array substrate is provided with a plurality of common voltage lines CL1 to CLn for supplying a common voltage Vcom to the pixels P1. The respective common voltage lines CL1 to CLn are adjacent to the respective gate lines GL1 to GLn and are extended along the gate lines GL1 to GLn.

Generally, the switching device T1 includes a thin film transistor. A source electrode of the switching device T1 is connected with the data lines DL1 to DLm, its gate electrode is connected to the gate lines GL1 to GLn, and its drain electrode is connected to the pixel electrode 11.

The pixel P1 is provided with not only the pixel electrode 11 but also a common electrode 13. The common electrode 13 is electrically connected to the common voltage lines CL1 to CLn, and is applied with the common voltage Vcom. The common electrode 13 is arranged in the pixel P1 in an alternating pattern and parallel with the pixel electrode 11.

In the aforementioned IPS mode LCD device, when a scan signal is sequentially applied to the gate lines GL1 to GLn from a gate driver, the switching devices T1 connected to gate electrodes of corresponding gate lines GL1 to GLn are turned on by the voltage of the scan signal. At this time, an image signal output from a data driver is applied to the pixel electrode 11 through the source electrode of the switching device T1. A data voltage according to the image signal is applied to the pixel electrode 11.

The common electrode 13 is applied with the common voltage Vcom through the common voltage lines CL1 to CLn, and generates a horizontal electric field in the pixel P1 area along with the pixel electrode 11 arranged in parallel therewith. The liquid crystal inside the pixel P1 is rearranged by the horizontal electric field. Arrangement of the liquid crystal changes based upon the intensity of the electric field, thereby varying the transmittance of the light supplied from a lamp. Since the common voltage lines CL1 to CLn are electrically connected to one another, the same common voltage is applied to each common electrode 13 through the common voltage lines CL1 to CLn.

However, the aforementioned IPS mode LCD device has several problems. That is, because the common and pixel electrodes are both arranged on the same thin film transistor array substrate for plane driving of the liquid crystal, an aperture ratio is low and luminance is reduced.

Also, when the scan signal is changed to a low potential, the data voltage is dropped at a certain size due to coupling between the gate electrode and the drain electrode of the switching device, whereby a flicker occurs, which causes images of irregular gray level. If such a flicker occurs in every pixel of the LCD panel, picture quality may be seriously deteriorated.

SUMMARY OF THE INVENTION

Accordingly, the present invention is directed to an in plane switching mode liquid crystal display device that substantially obviates one or more problems due to limitations and disadvantages of the related art.

An advantage of the present invention is to provide an IPS mode LCD device, in which a common voltage is generated on the basis of an n−1th gate voltage and an nth gate voltage, and the generated common voltage is supplied to common electrodes, whereby a circuit for the common voltage and additional elements thereof are omitted.

Another advantage of the present invention is to provide an IPS mode LCD device, in which data and common voltages displaying image information are charged in pixels for the same time period to remove charge deviation that may occur in each gate line due to delay and distortion of scan signals, and the same voltage change of the data and common voltages is induced to reduce deterioration of picture quality, such as a flicker.

Additional features and advantages of the invention will be set forth in the description which follows, and in part will be apparent from the description, or may be learned by practice of the invention. These and other advantages of the invention will be realized and attained by the structure particularly pointed out in the written description and claims here of as well as appended drawings.

To achieve these and other advantages and in accordance with the purpose of the present invention, as embodied and broadly described herein, there is provided an IPS mode LCD device, which comprises first and second substrates, N gate lines arranged on the first substrate substantially in parallel, M data lines arranged to cross the gate lines so as to define m×n pixel regions, a plurality of first switching devices formed at each crossing of the gate lines and the data lines, first electrodes electrically connected to the first switching devices, second electrodes generating a horizontal electric field along with the first electrodes in the pixel regions, a common voltage supplier generating a common voltage from an n−1th gate line and an nth gate line and supplying the generated common voltage to the second electrodes, and a liquid crystal layer formed between the first and second substrates.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
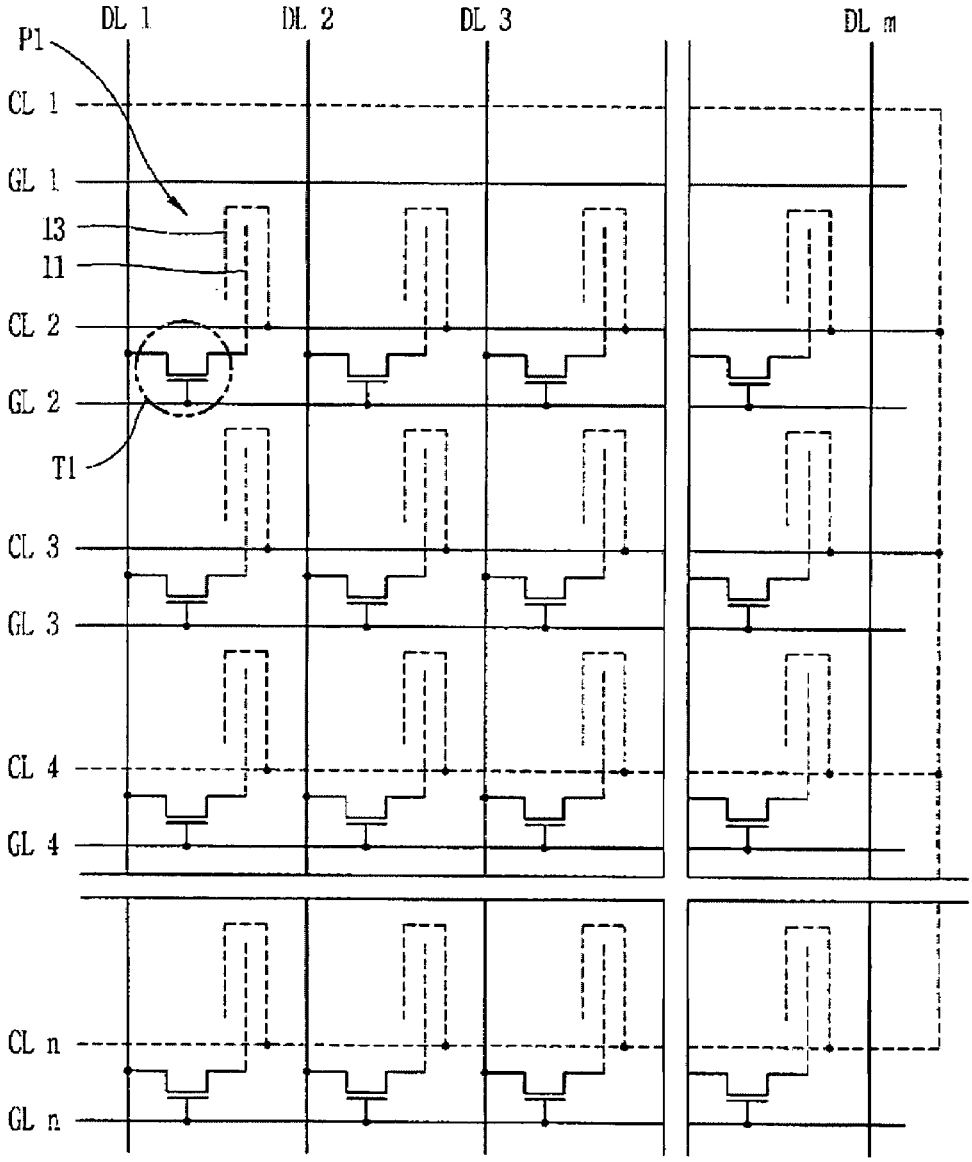
FIG. 1 RELATED ART
FIG. 1 is a plan view illustrating a thin film transistor array substrate in a general IPS mode LCD device.
Figure 2:
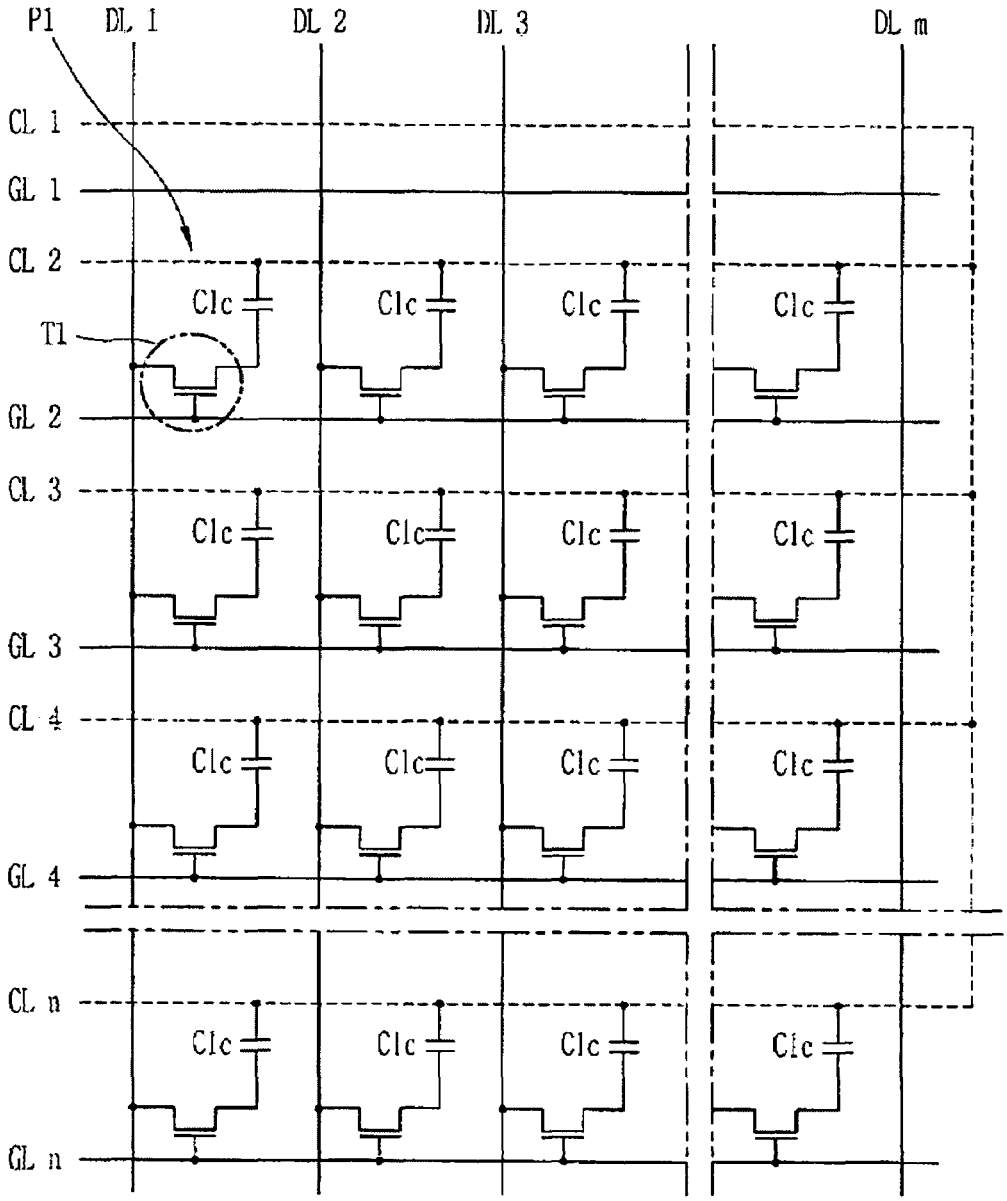
FIG. 2 RELATED ART
FIG. 2 is a circuit diagram illustrating an equivalent circuit of FIG. 1.
Figure 3:
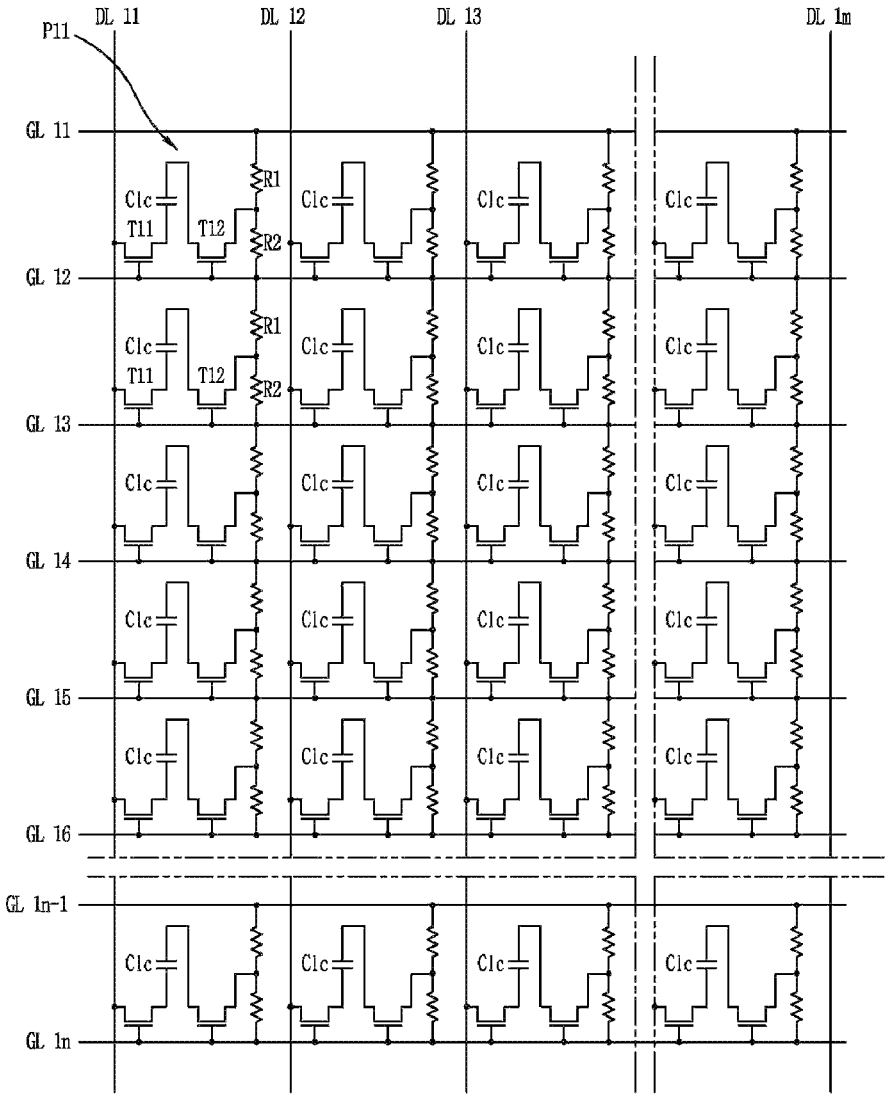
FIG. 3 is a circuit diagram illustrating an equivalent circuit of an IPS mode LCD device according to an embodiment of the present invention.
Figure 4:
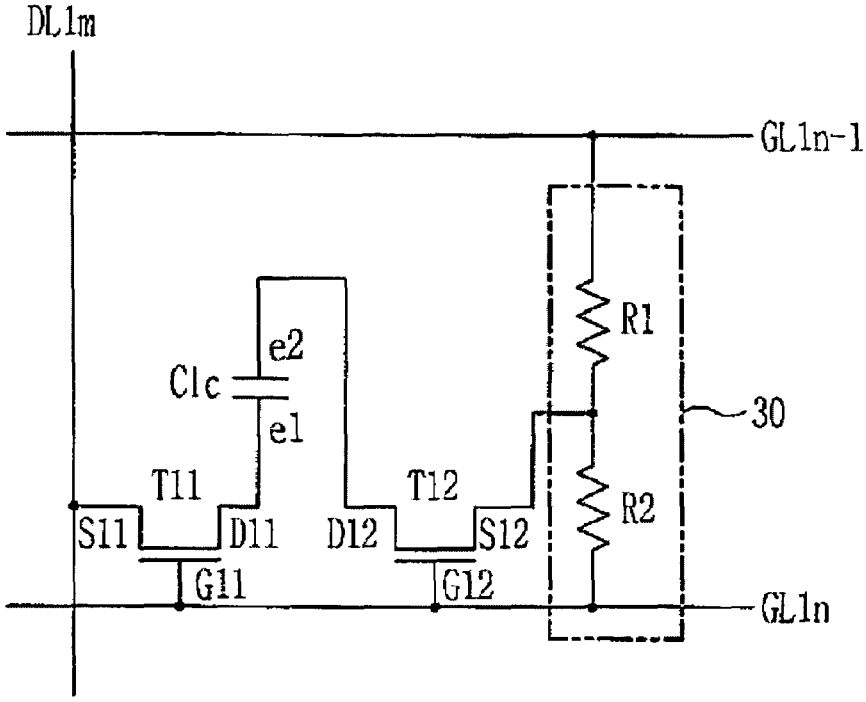
FIG. 4 is a circuit diagram illustrating an enlarged unit pixel of an IPS mode LCD device according to an embodiment of the present invention.

FIG. 3 is a circuit diagram illustrating an equivalent circuit of an IPS mode LCD device according to an embodiment of the present invention, and FIG. 4 is a circuit diagram illustrating an enlarged unit pixel of FIG. 3.

As shown in FIG. 3 and FIG. 4, an IPS mode LCD device according to the present invention includes first and second substrates (not shown), N gate lines GL11 to GL1n arranged on the first substrate in a horizontal direction, and M data lines DL11 to DLm arranged to cross the gate lines GL11 to GL1n so as to define m×n pixels P11, first switching devices T11 formed at each crossing of the gate lines GL11 to GL1n and the data lines DL11 to DLm , first and second electrodes E1 and E2 supplied with data and common voltages displaying image information, generating a horizontal electric field in the pixels P11 due to the difference between the supplied voltages, a common voltage supplier 30 generating a common voltage Vcom from an n−1 th gate line GL1n−1 and an nth gate line GL1n, which supply different voltages, and applying the generated common voltage Vcom to the second electrodes E2, second switching devices T12 supplying the common voltage Vcom generated from the common voltage supplier 30 to the second electrodes E2 in accordance with scan signals (gate voltages) supplied from the gate lines GL11 to GL1n, and a liquid crystal layer (not shown) formed between the first and second substrates.

One unit pixel P11 constituting the LCD device according to the present invention includes a first switching device T11, a second switching device T12, and a common voltage supplier 30.

In an embodiment, the common voltage supplier 30 includes two resistors R1 and R2 connected to the n−1th gate line GL1n−1 and the nth gate line GL1*n* in series. In other words, the common voltage supplier 30 supplies the common voltage Vcom from one end of each of the resistors R1 and R2 connected in series between the n−1th gate line GL1n−1 to which a low voltage (for example, −5V) is applied and the nth gate line GL1*n* to which a high voltage (for example, 25V) is applied. The sizes of the resistors R1 and R2 are set in advance by the principle of voltage distribution considering the size of the common voltage Vcom. Each of the resistors R1 and R2 may be comprised of a plurality of sub resistors connected in parallel and/or in series.

The two resistors R1 and R2 may be formed of a transparent conductive material such as indium tin oxide (ITO) and indium zinc oxide (IZO) during the process of forming the gate lines GL11 to GL1n, the data lines DL11 to DLm or the first electrodes E1.

The first electrodes E1 are the pixel electrodes to which the data voltage displaying image information is applied through the data lines DL11 to DLm, and the second electrodes E2 are the common electrodes to which the common voltage Vcom generated from the common voltage supplier 30 is supplied. The first and second electrodes E1 and E2 may be formed of a transparent conductive material such as indium tin oxide (ITO) and indium zinc oxide (IZO).

Thin film transistors may be used as the first and second switching devices T11 and T12.

Hereinafter, connection between the devices constituting the unit pixel P11 will be described in detail.

First, as shown in FIG. 4, the first source electrode S11 of the first switching device T11 is connected to the mth data line DLm, the first gate electrode of the first switching device T11 is connected to the nth gate line GL1n, and the first drain electrode D11 of the first switching device T11 is connected to the first electrode E1.

In the same manner as the first electrode E1, the second electrode E2, applying a horizontal electric field to the unit pixel P11, is connected to the second drain electrode D12 of the second switching device T12.

The second gate electrode G12 of the second switching device T12 is connected to the nth gate line GL1n. That is, the first gate electrode G11 of the first switching device T11 and the second gate electrode G12 of the second switching device T12 are connected to the same gate line GL1n.

The second source electrode S12 of the second switching device T12 is connected to an output terminal of the common voltage supplier 30. That is, if the common voltage supplier 30 includes two resistors R1 and R2 connected to the n−1th gate line GL1n−1 and the nth gate line GL1n in series, the second source electrode of the second switching device T12 is connected to a connection node of the two resistors R1 and R2.

A liquid crystal capacitor Clc is formed between the first and second switching devices T11 and T12. That is, the first electrode E1 (pixel electrode) and the second electrode E2 (common electrode) which are spaced apart from each other at a certain interval and arranged to cross each other serve as the capacitors. Although not shown, the liquid crystal capacitor Clc may additionally be connected to a storage capacitor substantially in parallel to supplement a charge function for charging the difference between the data voltage and the common voltage.

Since the first and second drain electrodes D11 and D12 of the first and second switching devices T11 and T12 are respectively connected to the first and second electrodes E1 and E2, the data voltage applied to the first electrode E1 and the common voltage applied to the second electrode E2 are blocked or transmitted by the first and second switching devices T11 and T12.

Hereinafter, the process of driving the LCD device according to the present invention will be described with reference to FIG. 5.

Figure 5:
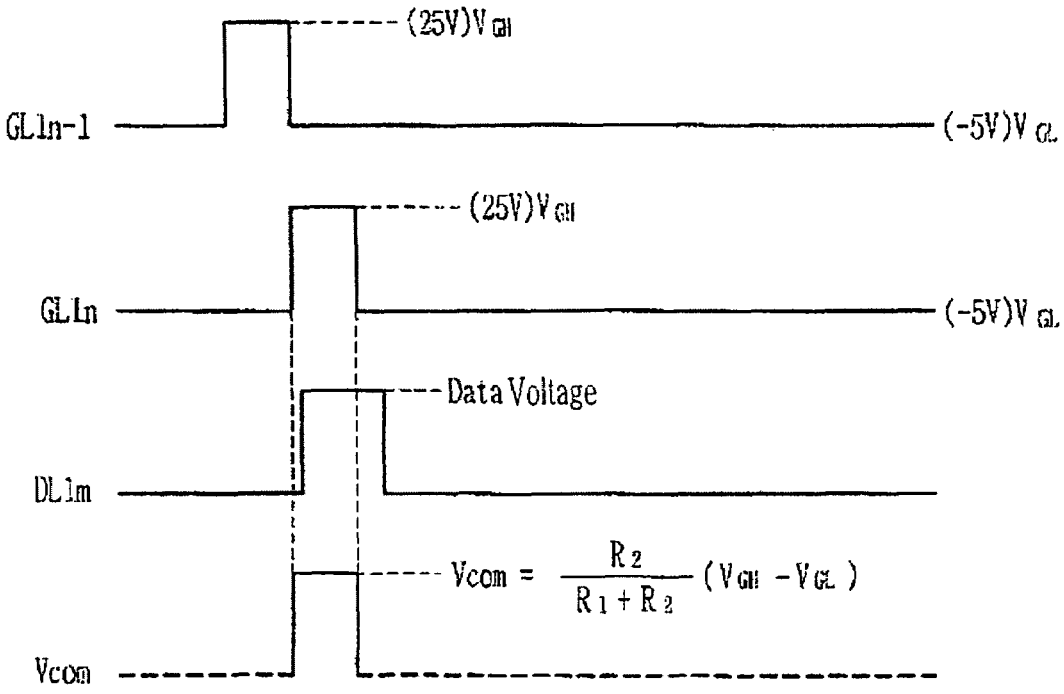
FIG. 5 is an exemplary view illustrating waveforms of voltages displayed in an LCD device according to the present invention.

FIG. 5 is an exemplary view illustrating waveforms of voltages displayed in the LCD device according to the present invention.

As shown in FIG. 5, scan signals (gate voltages) are sequentially applied from a gate driver to the gate lines GL11 to GL1*n* in one line unit for one frame period.

In other words, a high voltage $V_{GH}$ is applied to the n−1th gate line GL1n for a certain time period and then a low voltage $V_{GL}$ is applied thereto. Subsequently, the high voltage $V_{GH}$ is applied to the nth gate line GL1 for a certain time period and then a low voltage $V_{GL}$ is applied thereto. For example, the high voltage $V_{GH}$ may be 25V, and the low voltage $V_{GL}$ may be −5V.

At this time, while the high voltage VGH is applied to the nth gate line GL1*n* , scan signals (gate voltages) of the high voltage are applied to the first and second gate electrodes G11 and G12 of the first and second switching devices T11 and T12 connected to the nth gate line GL1*n*.

Accordingly, a conductive channel is formed between the first and second source electrodes S11 and S12 of the first and second switching devices T11 and T12, so that the first and second switching devices T11 and T12 are turned on.

Since the low voltage $V_{GL}$ is applied to the n−1th gate line GL1n−1 while the high voltage $V_{GH}$ is applied to the nth gate line GL1*n*, the common voltage supplier 30 generates the common voltage Vcom on the basis of the high voltage $V_{GH}$ applied to the nth gate line GL1n and the low voltage $V_{GL}$ applied to the n−1th gate line GL1n−1. In other words, the common voltage supplier 30 generates the common voltage Vcom from the connection node of the resistors R1 and R2 connected in series between the n−1th gate line GL1n−1 and the nth gate line GL1n in accordance with the principle of voltage distribution. The size of the generated common voltage Vcom is determined by the following equation 1 in accordance with the principle of voltage distribution.

$$Vcom=\{R_2/(R_1+R_2)\}\times(V_{GH}-V_{GL}) \quad \text{[Equation 1]}$$

Accordingly, as the first and second switching devices T11 and T12 provided in the unit pixel P11 are simultaneously turned on, the data voltage supplied from the data line DL1*m* is applied to the first electrode E1 through the first source electrode S11 and the first drain electrode D11 of the first switching device T11. The common voltage Vcom output from common voltage supplier 30 is supplied to the second source electrode S12 of the second switching device T12 and then applied to the second electrode E2 through the second drain electrode D12. Accordingly, an electric field which rearranges the liquid crystal between the first electrode E1 and the second electrode E2 is formed by the voltage difference between the first electrode E1 and the second electrode E2.

The data voltage according to image information is applied to the first electrode E1 for a turn-on time period of the first switching device T11, and the common voltage Vcom generated from the common voltage supplier 30 is supplied to the second electrode E2 for the turn-on time period of the first switching device T11.

If the scan signal supplied to the nth gate line GL1n at a high voltage is changed to low voltage, the conductive channel formed in the first and second switching devices T11 and T12 is closed and the first and second switching devices T11 and T12 are turned off. At this time, the first electrode E1 is electrically disconnected with the data line DL1m by the first switching device T11 and thus is in a floating state. The second electrode E2 is electrically disconnected with the common voltage supplier 30 by the second switching device T12 and thus also is in a floating state. Accordingly, the voltage difference between the pixel voltage and the common voltage charged in the first and second electrodes E1 and E2 charged for the turn-on time period is maintained. The pixel voltage stored in the first electrode E1 is dropped at a certain range by coupling between the first gate electrode G11 and the first drain electrode D11 at the time when the scan signal applied to the first gate electrode G11 of the first switching device T11 is changed from high potential to low potential, whereby the voltage difference to be maintained in the liquid crystal capacitor Clc may decrease or increase.

However, since the scan signal applied to the second gate electrode G12 of the second switching device T12 is also changed to a low voltage at the time when the scan signal of the nth gate line GL1n supplied to the first gate electrode G11 of the first switching device T11 is changed to a low voltage, a voltage drop also occurs in the second switching device T12 due to the same coupling.

In the present invention, a circuit for the common voltage supplier 30 is additional formed so that the pixel voltage and the common voltage may equally be dropped. Thus, the voltage charged in the liquid crystal capacitor Clc is uniformly maintained. In other words, the voltage drop of the pixel voltage and the common voltage due to coupling generated in the first and second switching devices T11 and T12 is neither minimized nor removed but is equally made.

Preferably, in order to equally make a voltage change range of the pixel voltage and the common voltage, the first and second switching devices T11 and T12 have the same voltage characteristics.

In the present invention, since the common voltage supplier 30 comprised of resistors is formed simultaneously when the data lines, the gate lines or the pixel electrodes are formed, no common voltage generating circuit generating the common voltage Vcom is required unlike the related art. Also, since the first and second switching devices T11 and T12 are simultaneously turned on and the data voltage and the common voltage are respectively charged in the first and second electrodes E1 and E2 for the same turn-on time period, deviation of charge range, which may occur in each pixel P11 by delay of the scan signal of each of the gate lines GL11 to GL1n, can be minimized.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An IPS mode LCD device comprising:

first and second substrates;

N gate lines arranged on the first substrate substantially in parallel and the N gate lines sequentially applied with a scan signal from a gate driver;

M data lines arranged to cross the gate lines so as to define m×n pixel regions;

a plurality of first switching devices formed at each crossing of the gate lines and the data lines;

first electrodes electrically connected to the first switching devices;

second electrodes electrically connected to a plurality of second switching devices, each pixel region including one of the first electrodes and one of the second electrodes that generate a horizontal electric field;

a common voltage supplier in each pixel region that generates a common voltage from voltages applied to a n−1th gate line and a nth gate line and supplies the generated common voltage to one of the second electrodes through one of the second switching devices, wherein control terminals of both one of the first switching devices and one of the second switching devices in each pixel region are electrically connected to the nth gate line; and a liquid crystal layer between the first and second substrates.

2. The IPS mode LCD device as claimed in claim 1, wherein the first electrodes are pixel electrodes, and the second electrodes are common electrodes.

3. The IPS mode LCD device as claimed in claim 1, wherein each of the first switching devices includes a first source electrode connected to the data lines, a first gate electrode connected to the gate lines, and a first drain electrode connected to the first electrodes.

4. The IPS mode LCD device as claimed in claim 1, wherein the first switching devices are thin film transistors.

5. The IPS mode LCD device as claimed in claim 1, wherein the common voltage generated from the common voltage supplier is supplied to the one of the second electrodes in accordance with the scan signal supplied from the nth gate line.

6. The IPS mode LCD device as claimed in claim 5, wherein each of the second switching devices includes a second source electrode connected to an output terminal of the common voltage supplier, a second gate electrode connected to the gate lines, and a second drain electrode connected to the second electrodes.

7. The IPS mode LCD device as claimed in claim 5, wherein the second switching devices are thin film transistors.

8. The IPS mode LCD device as claimed in claim 1, wherein the first and second electrodes are formed of a transparent conductive material.

9. The IPS mode LCD device as claimed in claim 1, wherein the common voltage supplier includes at least two resistors connected in series to the n−1th gate line and the nth gate line.

10. The IPS mode LCD device as claimed in claim 9, wherein the two resistors are formed during at least one of forming the gate lines, forming the data lines, and forming the first electrodes.

11. The IPS mode LCD device as claimed in claim 9, wherein the two resistors include at least one of a metal and a transparent conductive material.

* * * * *